US009968979B2

(12) United States Patent
Shimizu

(10) Patent No.: US 9,968,979 B2
(45) Date of Patent: May 15, 2018

(54) METHOD OF FORMING A PRESS-FORMED COMPONENT AND A DIE APPARATUS FOR FORMING A PRESS-FORMED COMPONENT

(71) Applicant: KABUSHIKI KAISHA F.C.C., Shizuoka (JP)

(72) Inventor: Yuki Shimizu, Hamamatsu (JP)

(73) Assignee: KABUSHIKI KAISHA F.C.C., Hamamatsu-Shi (JP)

( * ) Notice: Subject to any disclaimer, the term of this patent is extended or adjusted under 35 U.S.C. 154(b) by 829 days.

(21) Appl. No.: 14/396,512

(22) PCT Filed: Mar. 27, 2013

(86) PCT No.: PCT/JP2013/058925

§ 371 (c)(1),
(2) Date: Oct. 23, 2014

(87) PCT Pub. No.: WO2013/161490

PCT Pub. Date: Oct. 31, 2013

(65) Prior Publication Data

US 2015/0114067 A1 Apr. 30, 2015

(30) Foreign Application Priority Data

Apr. 27, 2012 (JP) ..... 2012-104190

(51) Int. Cl.

| | |
|---|---|
| ***B21D 22/30*** | (2006.01) |
| ***B21D 35/00*** | (2006.01) |
| ***B21D 28/28*** | (2006.01) |
| ***B21D 53/26*** | (2006.01) |

(Continued)

(52) U.S. Cl.

CPC ..... *B21D 35/001* (2013.01); *B21C 1/16* (2013.01); *B21D 22/30* (2013.01); *B21D 28/28* (2013.01);

(Continued)

(58) Field of Classification Search

CPC ..... B21D 1/16; B21D 22/30; B21D 28/28; B21D 31/02; B21D 37/02; B21D 53/26;

(Continued)

(56) References Cited

U.S. PATENT DOCUMENTS 2,157,354 A * 5/1939 Sherman ..... B21C 1/00 29/896.6
3,610,015 A * 10/1971 Bollmann ..... B21C 23/14 72/264

(Continued)

FOREIGN PATENT DOCUMENTS

CN 1817553 A 8/2006
CN 101209472 7/2008

(Continued)

*Primary Examiner* — David B Jones
(74) *Attorney, Agent, or Firm* — Michael Tobias

(57) ABSTRACT

A die apparatus for forming a press-formed component includes a piercing die, a piercing punch, and a support. The piercing die includes a tubular first forming portion for forming a boss portion and a second forming portion having a cutting edge and an inwardly extending portion. The second forming portion is adapted to perform pressing of a preform while cutting a portion thereof. A cutting edge which cooperates with the cutting edge of the second forming portion is formed at a distal end of the piercing punch. When forming a press-formed component, a projection end portion of a preform formed from a blank by drawing is cut and removed by the two cutting edges, and a preform boss portion is then pressed and swaged by the inwardly extending portion.

13 Claims, 5 Drawing Sheets

(51) Int. Cl.
*B21C 1/16* (2006.01)
*B21D 31/02* (2006.01)
*B21D 37/12* (2006.01)

(52) U.S. Cl.
CPC ..... *B21D 31/02* (2013.01); *B21D 37/12* (2013.01); *B21D 53/26* (2013.01)

(58) Field of Classification Search
CPC .. B21D 35/001; B21D 37/01; B21D 35/0012; B21C 1/16
USPC ..... 72/274
See application file for complete search history.

(56) References Cited

U.S. PATENT DOCUMENTS 4,109,501 A * 8/1978 Kozima ..... B21D 31/02 72/327
4,245,491 A 1/1981 Kondo et al. ..... 72/254
4,400,965 A * 8/1983 Schey ..... B21D 19/08 29/890.043
5,312,080 A * 5/1994 Mazur ..... B21D 22/04 248/300
7,775,078 B2 * 8/2010 Fisk ..... B21D 19/088 72/325

FOREIGN PATENT DOCUMENTS

| | | |
|---|---|---|
| CN | 201625717 | 11/2010 |
| CN | 201791835 | 4/2011 |
| JP | 5351172 | 5/1978 |
| JP | 63-260631 | 10/1988 |
| JP | 06-087039 | 3/1994 |
| JP | 09-192762 | 7/1997 |
| JP | 11179446 | 7/1999 |
| JP | 2000317565 | 11/2000 |
| JP | 2001259750 | 9/2001 |
| JP | 2007-090421 | 4/2007 |

* cited by examiner (A)

(B)

(A)

(B)

(A)

(B)

METHOD OF FORMING A PRESS-FORMED COMPONENT AND A DIE APPARATUS FOR FORMING A PRESS-FORMED COMPONENT

TECHNICAL FIELD

The present invention relates to a method for forming a press-formed metal component having a tubular boss portion and a flange portion extending from one end of the boss portion, a method for manufacturing such a press-formed component, and a die used for forming such a press-formed component.

BACKGROUND ART

In general, a clutch apparatus mounted on an automobile, a motorcycle, or the like includes press-formed metal components each having a tubular boss portion and a flange portion extending from one end of the boss portion. Examples of these components include a clutch guide, an end plate, a clutch piston, a hub gear, and a pulley. In general, these press-formed components are formed by drawing, burring, punching, and cutting.

For example, below-listed Patent Document 1 discloses a method of forming a press-formed component. In the forming method, a preform is used. The preform is formed from a flat blank through drawing such that a protruding preform boss portion is formed at a center portion of the blank. After the wall thickness of the preform boss portion is increased, a projection end portion of the preform boss portion is removed, whereby the press-formed component is completed. In the method, the step of increasing the wall thickness of the preform boss portion is a so-called swaging process for increasing the wall thickness of the preform boss portion which has decreased as a result of the drawing of the preform boss portion. Specifically, the preform is disposed in a die apparatus in which flow of the material is restricted by an upper die, a lower die, and a lower punch. In this state, a corner portion of the preform boss portion is pressed from the outer side by an upper punch, whereby the wall thickness of the preform boss portion is increased.

PRIOR ART DOCUMENTS

Patent Documents

Patent Document 1: Japanese Patent Application Laid-Open (kokai) No. 2000-317565

However, the method of forming a press-formed component described in Patent Document 1 has the following problems. Since a step of performing swaging on the preform boss portion so as to increase its wall thickness and the step of removing the projection end portion are separate steps, the manufacturing efficiency of the press-formed component is low. In the case where an ordinary press forming method is applied to a high strength material such as high tension steel so as to form the preform boss portion, the boss portion formed by subsequent burring is likely to suffer forming defects such as breakage and cracking.

The present invention was accomplished in order to solve the above-described problems, and one of its objects is to provide a method for forming a press-formed metal component having a tubular boss portion and a flange portion extending from one end of the boss portion. The method can improve manufacturing efficiency and can accurately form the component even when it is formed of a high strength material. Another object of the present invention is to provide a method for manufacturing such a press-formed component. Still another object of the present invention is to provide a die used for forming such a press-formed component.

SUMMARY OF THE INVENTION

In order to achieve the above-described object, the invention of claim 1 provides a method for forming a press-formed metal component having a tubular boss portion and a flange portion extending from one end of the boss portion. In the method, there are prepared a preform of the press-formed component which is formed from a flat blank through drawing performed such that a protruding preform boss portion is formed at a center portion of the blank; preparing a piercing die having a tubular first forming portion and a second forming portion, the first forming portion having a shape corresponding to an external shape of the boss portion of the press-formed component, and the second forming portion having an inwardly extending portion which projects inward in relation to the first forming portion by an amount corresponding to a wall thickness of the boss portion and a cutting edge formed at an end of the inwardly extending portion; a piercing punch which has a cutting edge which cooperates with the cutting edge of the second forming portion and which enters the piercing die and forms an internal shape of the boss portion of the press-formed component; and a support which is disposed around the piercing punch to face the piercing die and which supports the flange portion of the press-formed component. The method comprises a projection end portion removal step of causing the piercing die and the piercing punch disposed outside and inside, respectively, the preform boss portion of the preform to move relative to each other so as to cause the piercing punch to enter the piercing die from the first forming portion side and separate a projection end portion of the preform boss portion of the preform by using the piercing punch and the second forming portion of the piercing die; and a swaging step of causing the piercing die and the support to move relative to each other so as to press the preform boss portion by the inwardly extending portion of the second forming portion of the piercing die to thereby swage the preform boss portion.

According to the feature of the invention of claim 1, in the press-formed component forming method, the piercing punch and the piercing die are caused to move relative to each other with the preform disposed therebetween to thereby punch out the projection end portion of the preform boss portion of the preform by the piercing punch and the piercing die, and to continuously perform swaging after the punching out of the projection end portion so as to increase the wall thickness of the preform boss portion. Namely, in the press-formed component forming method according to the present invention, the step of removing the projection end portion from the preform boss portion and the step of swaging for increasing the wall thickness are realized by a continuous single step. As a result, the press-formed component forming method according to the present invention can manufacture more efficiently a press-formed component formed of metal and having a tubular boss portion and a flange portion extending from one end of the boss portion and can form the press-formed component accurately even when the press-formed component is formed of high strength material.

The present invention can be implemented not only as an invention of a press-formed component forming method but also as an invention of a press-formed component manufacturing method and an invention of a press-formed component forming die.

Specifically, as shown in claim 2, the present invention can be implemented as a method for manufacturing a press-formed metal component having a tubular boss portion and a flange portion extending from one end of the boss portion. In the manufacturing method, there are prepared a preform of the press-formed component which is formed from a flat blank through drawing performed such that a protruding preform boss portion is formed at a center portion of the blank; a piercing die having a tubular first forming portion and a second forming portion, the first forming portion having a shape corresponding to an external shape of the boss portion of the press-formed component, and the second forming portion having an inwardly extending portion which projects inward in relation to the first forming portion by an amount corresponding to a wall thickness of the boss portion and a cutting edge formed at an end of the inwardly extending portion; a piercing punch which has a cutting edge which cooperates with the cutting edge of the second forming portion and which enters the piercing die and forms an internal shape of the boss portion of the press-formed component; and a support which is disposed around the piercing punch to face the piercing die and which supports the flange portion of the press-formed component. The manufacturing method comprises a projection end portion removal step of causing the piercing die and the piercing punch respectively disposed outside and inside the preform boss portion of the preform to move relative to each other so as to cause the piercing punch to enter the piercing die from the first forming portion side and separate a projection end portion of the preform boss portion of the preform by using the piercing punch and the second forming portion of the piercing die; and a swaging step of causing the piercing die and the support to move relative to each other so as to press the preform boss portion by the inwardly extending portion of the second forming portion of the piercing die to thereby swage the preform boss portion. The manufacturing method is expected to provide an action and effects similar to those provided by the above-described press-formed component forming method.

Also, as shown in claim 3, the present invention can be implemented as a die apparatus for forming a press-formed metal component having a tubular boss portion and a flange portion extending from one end of the boss portion. The die apparatus comprises a piercing die having a tubular first forming portion and a second forming portion, the first forming portion having a shape corresponding to an external shape of the boss portion of the press-formed component, and the second forming portion having an inwardly extending portion which projects inward in relation to the first forming portion by an amount corresponding to a wall thickness of the boss portion and a cutting edge formed at an end of the inwardly extending portion; a piercing punch which has a cutting edge which cooperates with the cutting edge of the second forming portion and which enters the piercing die and forms an internal shape of the boss portion of the press-formed component; and a support which is disposed around the piercing punch to face the piercing die and which supports the flange portion of the press-formed component. The die apparatus is expected to provide an action and effects similar to those provided by the above-described press-formed component forming method.

BRIEF DESCRIPTION OF THE DRAWINGS

FIGS. 1(A) and 1(B) schematically show the structure of a press-formed component formed by a press-formed component forming method according to one embodiment of the present invention, wherein FIG. 1(A) is a plan view of the press-formed component, and FIG. 1(B) is a sectional view of the press-formed component taken along line A-A in FIG. 1(A).

FIGS. 2(A) and 2(B) are explanatory views used for describing a step of the press-formed component forming method according to the embodiment of the present invention, wherein FIG. 2(A) is a sectional view showing a state in which a preform has been set on a die apparatus, and FIG. 2(B) is a sectional view showing a state in which a piercing die has approached the preform.

FIGS. 3(A) and 3(B) are explanatory views used for describing a step of the press-formed component forming method according to the embodiment of the present invention, wherein FIG. 3(A) is a sectional view showing a state in which the piercing die and a piercing punch have started an operation of cutting the preform into parts, and FIG. 3(B) is a sectional view showing a state in which the piercing die and the piercing are swaging a preform boss portion of the preform after separation of a projection end portion of the preform.

MODE FOR CARRYING OUT THE INVENTION

Figure 1:
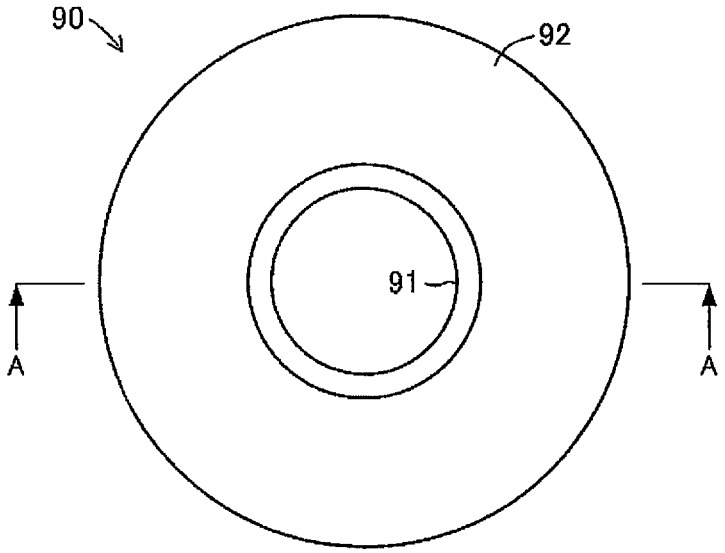
Figure 1:
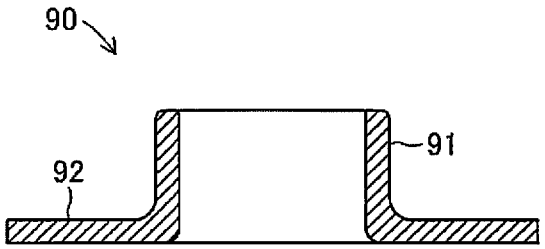

One embodiment of the press-formed component forming method according to the present invention will be described with reference to the drawings. FIGS. 1(A) and 1(B) schematically show the structure of a press-formed component 90 formed by a press-formed component forming method according to the present invention, wherein FIG. 1(A) is a plan view of the press-formed component 90, and FIG. 1(B) is a sectional view of the press-formed component 90 taken along line A-A in FIG. 1(A). FIGS. 2(A) and 2(B) and FIGS. 3(A) and 3(B) are sectional views schematically showing a state in which the press-formed component 90 is formed by the press-formed component forming method according to the present invention. In each of the drawings which will be referred to herein, some components are shown schematically, such as in an exaggerated manner so as to facilitate the understanding of the present invention. Therefore, the dimensions, dimensional ratios, etc. of the constituent elements may differ from the actual dimensions, dimensional ratios, etc.

First, the press-formed component 90 formed by the press-formed component forming method according to the present invention will be described briefly. The press-formed component 90 is used as a clutch guide, an end plate, a clutch piston, a hub gear, or a pulley which constitutes a clutch apparatus mounted on a vehicle such as an automobile or a motorcycle. The press-formed component 90 is formed from a plate of steel (for example, SPCC, SPCD, SPCE, carbon steel (such as S35C), or high tension steel). The press-formed component 90 has a tubular boss portion 91 and a flange portion 92 extending from one end of the boss portion 91.

(Structure of Die Apparatus 100)

Next, there will be described a die apparatus 100 for press-forming the press-formed component 90 by the press-formed component forming method according to the present invention. This die apparatus 100 is mainly composed of a piercing die 110, a piercing punch 120, and a support 130.

The piercing die 110 cooperates with the piercing punch 120 and the support 130 so as to cut and press a preform 90' (a half-worked product of the press-formed component 90) to thereby form the press-formed component 90. The piercing die 110 is formed of die steel and has a generally cylindrical shape. The radial dimension (in other words, the wall thickness) of the cylindrical piercing die 110 between the inner and outer circumferential surfaces thereof is greater than the radial dimension of the flange portion 92 of the press-formed component 90. A portion around a through hole formed at the center of the piercing die 110 is a portion for forming (shaping) the preform 90' and is composed of a first forming portion 111 and a second forming portion 112 having different inner diameters.

The first forming portion 111 is a portion for forming the boss portion 91 of the press-formed component 90. The first forming portion 111 has a cylindrical shape and extends upward from a lower end surface of the piercing die 110. The first forming portion 111 is formed to have an inner diameter approximately equal to the outer diameter of the boss portion 91 of the press-formed component 90 and is formed such that its inner diameter increases at the lower end thereof located adjacent to the lower end surface of the piercing die 110. The length of the first forming portion 111 is equal to the height of the press-formed component 90 from the upper surface of the flange portion 92 to the upper surface of the boss portion 91. In order to form the external shape of the boss portion 91 of the press-formed component 90, the first forming portion 111 has the shape of a cylindrical tube having a shape corresponding to the external shape. The second forming portion 112 is formed on the upper side of the first forming portion 111.

The second forming portion 112 is a portion for forming the boss portion 91 of the press-formed component 90. It continuously extends upward from the upper end of the first forming portion 111. More specifically, the second forming portion 112 is a tubular portion which projects, in relation to the first forming portion 111, toward the interior of the piercing die 110 by an amount corresponding to the wall thickness of the boss portion 91 of the press-formed component 90. A portion of the second forming portion 112 projecting from the first forming portion 111 is composed of an inwardly extending portion 112*a* which extends approximately perpendicular to the first tubular forming portion 111 (it extends horizontally in the drawings), and a right-angled cutting edge 112*b* which is formed at the end of the inwardly extending portion 112*a*.

A hole portion 113 provided on the upper side of the cutting edge 112*b* of the second forming portion 112 extends to the upper end surface of the piercing die 110 while maintaining the same inner diameter. Namely, the hole portion 113 has an inner diameter approximately equal to the inner diameter of the boss portion 91 of the press-formed component 90.

The piercing punch 120 is a die which cooperates with the piercing die 110 and the support 130 so as to cut and press the preform 90' (a half-worked product of the press-formed component 90) to thereby form the press-formed component 90. The piercing punch 120 is formed of die steel, and it generally has a cylindrical columnar shape. More specifically, the piercing punch 120 is a portion for forming the boss portion 91 of the press-formed component 90. The piercing punch 120 is formed to have the shape of a circular column with an outer diameter which is approximately equal to the inner diameter of the boss portion 91 of the press-formed component 90 and with a length which is equal to or greater than the height of the boss portion 91. A cutting edge 120*a* which cooperates with the cutting edge 112*b* of the second forming portion 112 is formed at a distal end (an upper end in the drawings) of the piercing punch 120. Namely, the piercing punch 120 and the piercing die 110 are so-called male and female dies which cut the preform 90' into parts, and the outer diameter of the piercing punch 120 and the inner diameter of the second forming portion 112 of the piercing die 110 are set such that a predetermined clearance is formed between the piercing punch 120 and the second forming portion 112.

The support 130 is a die which cooperates with the piercing die 110 and the piercing punch 120 so as to press the preform 90' (a half-worked product of the press-formed component 90) to thereby form the press-formed component 90. The support 130 is formed of die steel and generally has a cylindrical shape. More specifically, the support 130 is a table for supporting the preform 90' from the lower side when the preform 90' is pressed by the piercing die 110. The support 130 has a through hole through which the piercing punch 120 penetrates. The radial dimension of the support 130 between the wall surface of the through hole and the outer circumferential surface of the support 130 is greater than the radial dimension of the flange portion 92 of the press-formed component 90. Namely, the support 130 plays the role of a so-called female die for the piercing die 110 which is a so-called male die for pressing the preform 90'.

Figure 2:
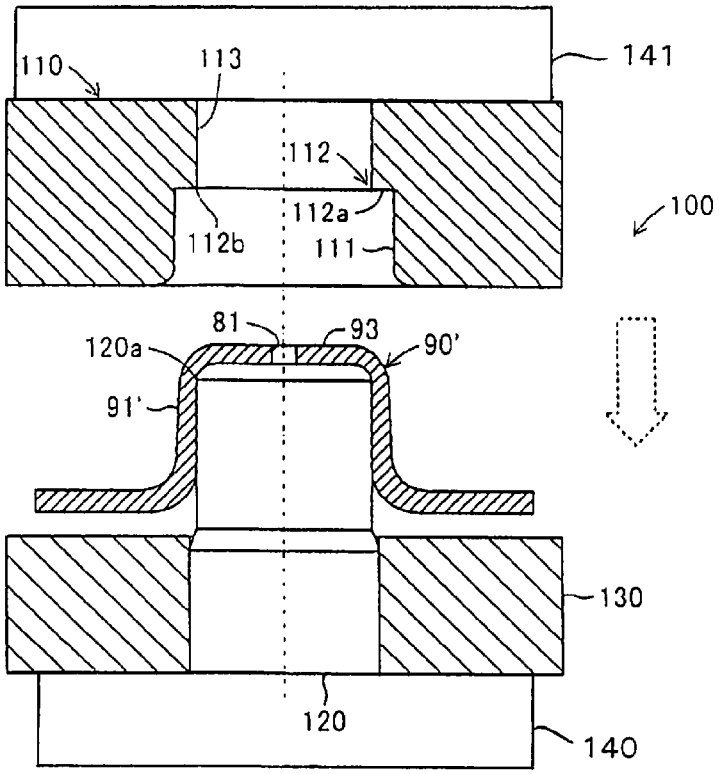
Figure 2:
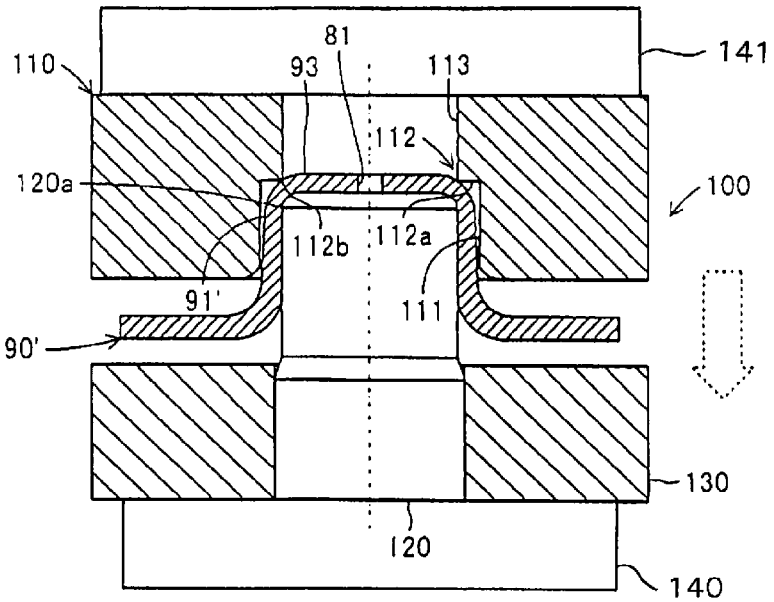
Figure 3:
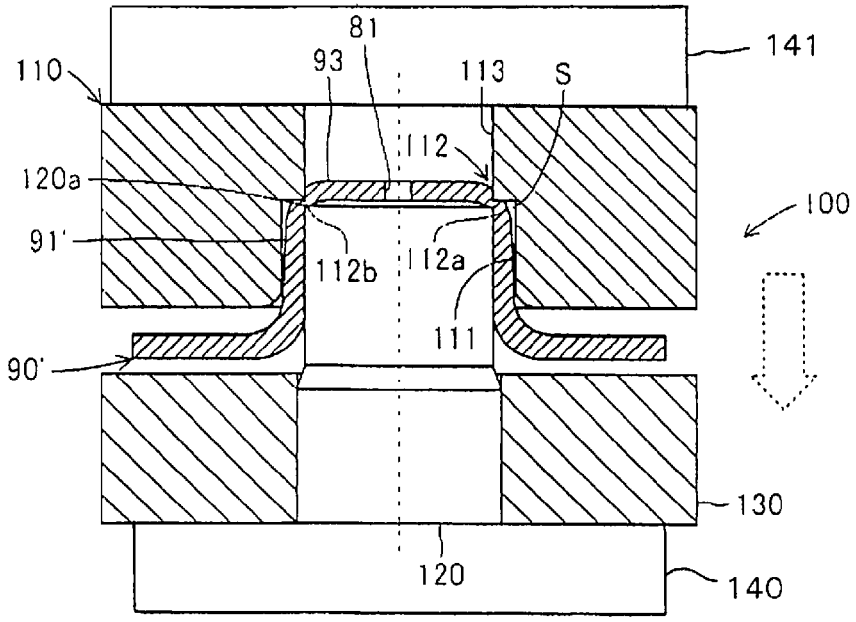
Figure 3:
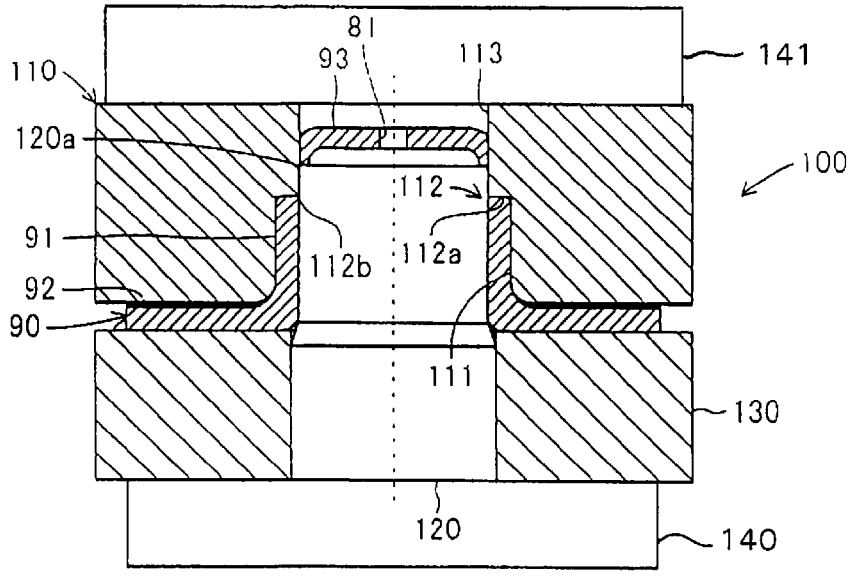
Figure 4:
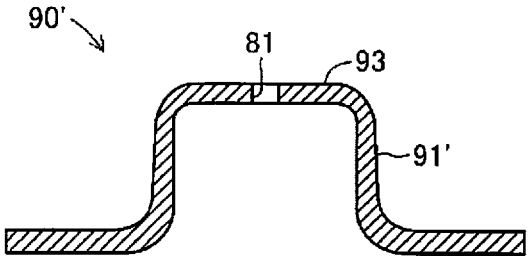
FIG. 4 is a sectional view showing a cross section of a preform formed by a preform forming process.

The piercing die 110, the piercing punch 120, and the support 130 which constitute the die apparatus 100 are attached to a press which forms the press-formed component 90 by pressing the preform 90' shown in FIG. 4. The press, which is schematically illustrated in FIGS. 2 and 3, includes a stationary portion 140 and a movable portion 141 which can be moved towards and away from the stationary portion 140.

The piercing punch 120 and the support 130 are fixedly provided on the stationary portion 140 of the press such that the support 130 is disposed around the piercing punch 120. The piercing die 110 is provided on the movable portion 141 of the press such that the piercing die 110 is coaxial with the piercing punch 120 and faces the support 130 and such that the piercing die 110 can move toward and away from the piercing punch 120 and the support 130.

(Formation of Press-Formed Component 90)

Figure 5:
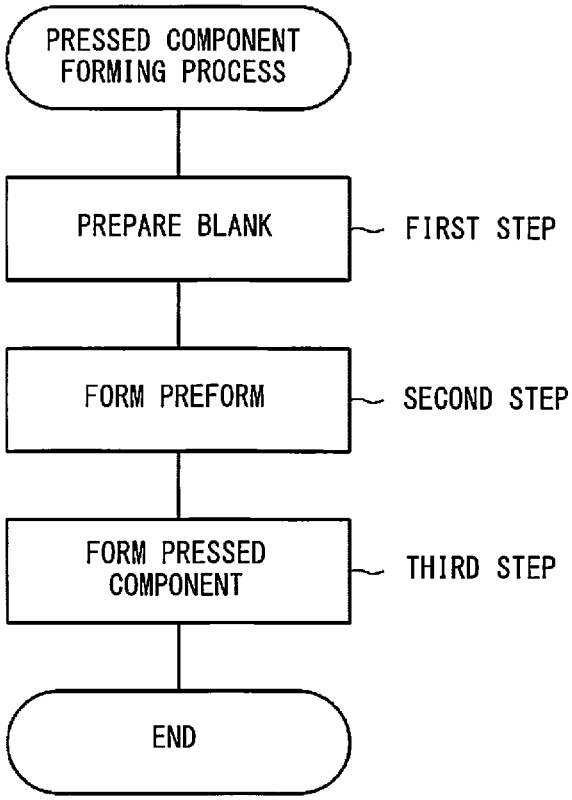
FIG. 5 is a flowchart showing a step of press-forming the press-formed component by the press-formed component forming method according to the embodiment of the present invention.

Next, a press-formed component forming method using the die apparatus 100 configured as described above will be described with reference to the flowchart of FIG. 5. FIG. 5 is a flowchart showing steps of press-forming the press-formed component 90.

Figure 6:
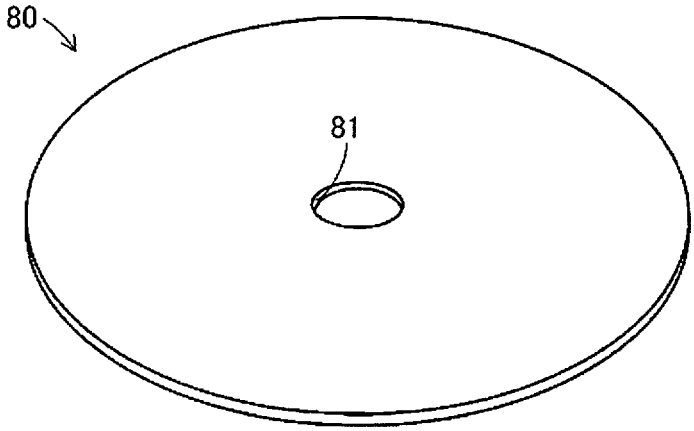
FIG. 6 is a perspective view schematically showing a blank used to form the preform which is used in the press-formed component forming method according to the embodiment of the present invention.

First, a worker prepares a blank 80 in a first step. Specifically, as shown in FIG. 6, the worker prepares a circular flat plate formed of steel (for example, SPCC, SPCD, SPCE, carbon steel (e.g., S35C), or high tension steel), and forms a positioning through hole 81 at the center of the plate using an unillustrated punching press to thereby obtain the blank 80. The through hole 81 formed in the blank 80 is used as a positioning hole in machines which press the preform 90'. Therefore, in the case where such a positioning hole is unnecessary in the machines, the through hole 81 may be omitted.

Figure 7:
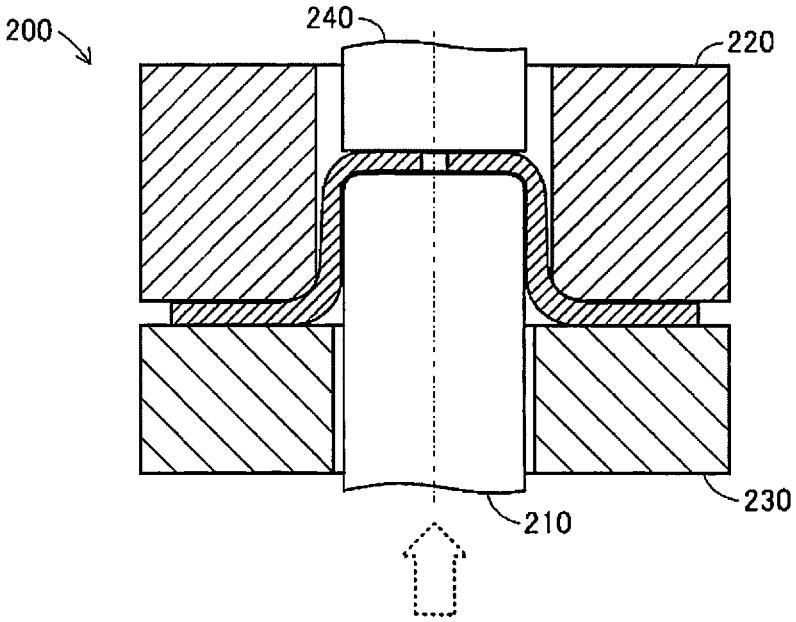
FIG. 7 is a sectional view showing formation of the preform used in the press-formed component forming method according to the embodiment of the present invention.

Next, the worker forms the preform 90' in a second step. FIG. 4 shows the preform 90'. The preform 90' is a material which is formed into the press-formed component 90 by the die apparatus 100. The preform 90' is a half-manufactured product obtained by forming a preform boss portion 91' at the center of the blank 80 through drawing such that the preform boss portion 91' protrudes from the blank 80. Specifically, the worker sets the blank 80 on a drawing machine (not shown) having, for example, a die apparatus 200 shown in FIG. 7, and forms the preform 90'.

The die apparatus 200 is a die apparatus for forming the preform 90' by plastically deforming the flat blank 80. The die apparatus 200 is mainly composed of a punch 210, a die 220, a blank holder 230, and an ejection pin 240. The punch 210 is a movable die for forming the preform boss portion 91' by pressing a center portion of the blank 80. The die 220 is a die which is disposed to face the punch 210 and which supports the blank 80 pressed by the punch 210. The blank holder 230 is a die for pressing a peripheral edge portion of the blank (which is pressed by the punch 210) against the die 220 so as to suppress occurrence of wrinkle defects which would otherwise occur as a result of formation of the preform boss portion 91'. The ejection pin 240 is a die for ejecting the preform 90' with the preform boss portion 91' formed thereon from the die 220.

Accordingly, the worker forms the preform 90' by setting the blank 80 into the die apparatus 200 and operating the unillustrated drawing machine. The preform 90' is formed stepwise (for example, in four steps) by using a plurality of die apparatuses 200 (not shown) for forming the preform boss portion 91' on the flat blank 80 little by little. As a result, as shown in FIG. 4, there is formed the preform 90' having the preform boss portion 91' formed at the center portion of the blank 80 such that the cylindrical preform boss portion 91' rises vertically and has a cylindrical tubular shape. In this case, the preform 90' is formed by drawing such that the wall thickness of the preform boss portion 91' decreases toward a projection end portion 93 of the preform boss portion 91'. The drawing of the preform 90' itself is a known technique.

Next, the worker forms the press-formed component 90 in a third step. Specifically, as shown in FIG. 2(A), the worker sets the preform 90' formed in the second step into the die apparatus 100 and operates the unillustrated press to thereby start press work on the preform 90'. In this case, the worker disposes the preform 90' such that the preform boss portion 91' of the preform 90' is fit onto the piercing punch 120. As shown in FIGS. 2(A) and 2(B), formation of the press-formed component 90 is performed through sub-steps 1 and 2 (which will be described next) after the press starts the movement of the piercing die 110 toward the piercing punch 120 and the support 130 (see the broken-line arrows).

Sub-step 1: First, the preform 90' is cut into parts such that the projection end portion 93 is cut and separated from the remaining portion of the preform 90'. Specifically, as shown in FIGS. 2(B) and 3(A), when the piercing die 110 is moved toward the piercing punch 120 and the support 130 (see broken-line arrows), the piercing punch 120 holding the preform 90' enters the through hole of the piercing die 110, and the cutting edge 112*b* of the second forming portion 112 comes into contact with the upper surface of the projection end portion 93. When the piercing punch 120 enters the through hole of the piercing die 110 further as a result of further advancement of the piercing die 110, the projection end portion 93 is cut and separated from the preform boss portion 91' by the cutting edge 112*b* of the second forming portion 112 and the cutting edge 120*a* of the piercing punch 120. As a result, the projection end portion 93 is removed from the preform 90'. Namely, the step of cutting and separating the projection end portion 93 from the preform boss portion 91' corresponds to the projection end portion removal step of the present invention.

In this step of separating the projection end portion 93, the projection end portion 93 prevents the preform boss portion 91' of the preform 90' from moving in the radial direction of the preform 90' up to a point when the projection end portion 93 is cut and separated. Namely, the preform boss portion 91' is maintained in a state in which radially outward shifting of the preform boss portion 91' is restrained. Therefore, it becomes unnecessary to fix the flange portion 92 of the preform 90'. Also, escape of the material forming the preform boss portion 91' to the radially outer side is prevented, whereby a so-called folding defect (folding of material due to contact with the first forming portion 111 of the piercing die 110) and a so-called sinking defect are prevented.

Sub-step 2: Next, the preform boss portion 91' of the preform 90' is swaged, whereby the boss portion 91 is formed. Specifically, as shown in FIG. 3(B), as a result of further advancement of the piercing die 110 (see the dashed-line arrow) after separation of the projection end portion 93 of the preform 90', the preform boss portion 91' from which the projection end portion 93 has been cut and separated is pressed by the inwardly extending portion 112*a* of the second forming portion 112 of the piercing die 110 within a region surrounded by the piercing die 110, the piercing punch 120, and the support 130.

A portion of the preform boss portion 91' on the side toward the projection end portion 93 has a wall thickness smaller than the final (target) wall thickness of the boss portion 91 due to the drawing in the second step. Therefore, a space S is formed in a region immediately below the inwardly extending portion 112*a* of the second forming portion 112 of the piercing die 110. Therefore, the material of the preform boss portion 91' pressed by the inwardly extending portion 112*a* of the piercing die 110 flows toward the space S. As a result, swaging is performed to change the height and wall thickness of the preform boss portion 91', whereby the boss portion 91 and the flange 92 are finally formed. Namely, this step of swaging the preform boss portion 91' corresponds to the swaging step of the present invention.

In the step of swaging the preform boss portion 91', when the preform boss portion 91' is compressed, material can flow into the space S between the inwardly extending portion 112*a* and the first forming portion 110. Therefore, it is possible to prevent a so-called folding defect when the boss portion 91 is formed and to decrease the compressive load. Also, when the preform boss portion 91' is compressed, the material at the boundary between the projection end portion 93 and the preform boss portion 91', which material remains on the cut surface (the upper end surface) of the preform boss portion 91', is compressed and formed together with the preform boss portion 91'. Therefore, the material can be utilized effectively, and yield can be increased.

As a result of the step of swaging the preform boss portion 91', the preform 90' is formed into the press-formed component 90. Therefore, after the step of swaging the preform boss portion 91', the movable portion 141 of the press moves the piercing die 110 in a direction away from the piercing punch 120 and the support 130. As a result, a state is created in which the formed press-formed component 90 can be removed from the die apparatus 100. Accordingly, the worker ends the operation of forming the press-formed component 90 by removing the press-formed component 90 from the opened die apparatus 100.

As can be understood from the above-described operation, in the press-formed component forming method of the embodiment, the piercing punch 120 and the piercing die 110 are caused to move relative to each other with the preform 90' disposed therebetween to thereby punch out the projection end portion 93 of the preform boss portion 91' of the preform 90' by the piercing punch 120 and the piercing die 110, and to continuously perform swaging after the punching out of the projection end portion 93 so as to increase the wall thickness of the preform boss portion 91'. Namely, in the press-formed component forming method according to the present invention, the step of removing the projection end portion 93 from the preform boss portion 91' and the step of swaging for increasing the wall thickness are realized by a continuous single step. As a result, the press-formed component forming method according to the present invention can manufacture more efficiently the press-formed component formed of metal and having the tubular boss portion 91 and the flange portion 92 extending from one end of the boss portion 91, and can form the press-formed component accurately even when the press-formed component is formed of high-strength material. Also, according to the press-formed component forming method according to the present invention, a material thinner than a conventionally used material can be used and can be formed into a shape having close to final dimensions (a shape which minimizes the machining allowance), whereby the amount of material to be removed by machining with a lathe can be minimized. Therefore, yield can be increased.

The present invention is not limited to the above-described embodiment, and it may be modified in various ways without departing from the scope of the present invention.

In the above-described embodiment, the piercing die 110 is moved relative to the piercing punch 120 and the support 130. However, since the movements of the piercing die 110, the piercing punch 120, and the support 130 are relative movements, each of these members can be the movable side or the stationary side. For example, the embodiment may be configured such that the piercing punch 120 and the support 130 move relative to the piercing die 110.

In the above-described embodiment, in the step of forming the preform 90'(the second step), the preform 90' is formed by deforming the blank 80 stepwise by using a plurality of die apparatuses 200. However, the number of steps of forming the preform 90' is not limited to that employed in the above-described embodiment, and the preform 90' may be formed by performing the drawing operation one time or five or more times.

In the above-described embodiment, the press-formed component 90 is a clutch guide, an end plate, a clutch piston, a hub gear, or a pulley which constitutes a clutch apparatus mounted on a vehicle such as an automobile or a motorcycle. However, the press-formed component 90 may be a component other than these components. Namely, the press-formed component forming method according to the present invention can be widely applied to press-formed components each having a tubular boss portion 91 and a flange portion 92 extending from one end of the boss portion 91. In this case, the shape of the press-formed component 90 is not limited to a cylindrical shape, and may be a so-called non-circular shape such as an elliptical shape or a polygonal shape (e.g., a triangular shape or a quadrilateral shape). Also, the press-formed component 90 may be a component which has teeth (e.g., involute teeth, spline teeth, or serrations) formed on the outer or inner circumference of the boss portion 91. In these cases, needless to say, the shapes of the die apparatuses 100 and 200 are set in accordance with the shape of the press-formed component 90.

The material of the press-formed component 90 is not limited to steel materials suitable for drawing such as SPCC, SPCD, and SPCE, and may be a metal material other than steel. In particular, even when the press-formed component 90 is formed of high carbon steel or high tension steel which are generally not suitable for drawing or burring, the press-formed component 90 can be formed accurately without causing forming defects such as breakage and cracking.

In the above-described embodiment, the die apparatus 100 performs a forming operation on the preform 90' in a state in which a peripheral edge portion of the flange portion 92 of the press-formed component 90 is free. This ensures a space to which the material escapes when the forming operation is performed on the preform 90'. Therefore, the preform 90' can be plastically deformed with a relatively low pressure. However, the die apparatus 100 can perform the forming operation on the preform 90' in a state in which a peripheral edge portion of the flange portion 92 of the press-formed component 90 is tightly held between the support and the piercing die. In this case, the press-formed component 90, including the shape of the flange portion 92 thereof, can be formed accurately.

DESCRIPTION OF REFERENCE NUMERALS

S . . . space
80 . . . blank, 81 . . . through hole,
90 . . . press-formed component, 91 . . . boss portion, 92 . . . flange portion, 93 . . . projection end portion,
90' . . . preform, 91' . . . preform boss portion,
100 . . . die apparatus,
110 . . . piercing die, 111 . . . first forming portion, 112 . . . second forming portion, **112*a* . . . inwardly extending portion, 112*b* . . . cutting edge, 113** . . . hole portion,
120 . . . piercing punch, **120*a*** . . . cutting edge,
130 . . . support,
200 . . . die apparatus, 210 . . . punch, 220 . . . die, 230 . . . blank holder, 240 . . . ejection pin.

The invention claimed is:

1. A method of forming a press-formed metal component having a tubular boss portion and a flange portion extending from one end of the boss portion, the method comprising:

preparing a preform of the press-formed component which is formed from a flat blank by drawing performed such that a protruding preform boss portion is formed at a center portion of the blank;

preparing a piercing die having a tubular first forming portion and a second forming portion, the first forming portion having a shape corresponding to an external shape of the boss portion of the press-formed component, and the second forming portion having an inwardly extending portion which projects inward in relation to the first forming portion by an amount corresponding to a wall thickness of the boss portion and a cutting edge formed at an end of the inwardly extending portion;

preparing a piercing punch which has a longitudinal axis, an outer peripheral surface which extends around the longitudinal axis, and a cutting edge which cooperates with the cutting edge of the second forming portion and which enters the piercing die and forms an internal shape of the boss portion of the press-formed component;

preparing a support which has a support surface for supporting the flange portion of the press-formed component, the support surface facing an external surface of the piercing die and extending further from the longitudinal axis of the piercing punch than the outer peripheral surface of the piercing punch in a radial direction of the piercing punch;

causing the piercing die and the piercing punch disposed outside and inside, respectively, the preform boss portion of the preform to move relative to each other so as to cause the piercing punch to enter the piercing die from the first forming portion side and remove a projection end portion of the preform boss portion of the preform by using the piercing punch and the second forming portion of the piercing die; and then causing the piercing die and the support to move relative to each other to axially compress the preform between the inwardly extending portion, which presses against an external surface of the preform at a first lengthwise end of the preform, and the support, which presses against an external surface of the preform at a second lengthwise end of the preform, so as to plastically deform the preform boss portion to increase its wall thickness and decrease its height.

2. A method as claimed in claim 1 wherein the longitudinal axis of the piercing punch is perpendicular to the support surface.

3. A method as claimed in claim 1 wherein the support surface is planar.

4. A method as claimed in claim 3 wherein the support surface is parallel to the external surface of the piercing die which the support surface faces.

5. A method as claimed in claim 1 wherein the piercing punch extends to the support surface in an axial direction of the piercing punch.

6. A method as claimed in claim 1 including disposing the flange portion of the preform between the support surface and the external surface of the piercing die without restraining the flange portion between the support surface and the external surface of the piercing die when removing the projection end portion of the preform boss portion.

7. A die apparatus for forming a press-formed metal component having a tubular boss portion and a flange portion extending from one end of the boss portion, the die apparatus comprising:

a piercing die having a tubular first forming portion and a second forming portion, the first forming portion having a shape corresponding to an external shape of the boss portion of the press-formed component, and the second forming portion having an inwardly extending portion which projects inward in relation to the first forming portion by an amount corresponding to a wall thickness of the boss portion and a cutting edge formed at an end of the inwardly extending portion;

a piercing punch which has a longitudinal axis, an outer peripheral surface which extends around the longitudinal axis, and a cutting edge which cooperates with the cutting edge of the second forming portion and which enters the piercing die and forms an internal shape of the boss portion of the press-formed component; and a support which has a support surface for supporting the flange portion of the press-formed component, the support surface facing an external surface of the piercing die and extending further from the longitudinal axis of the piercing punch than the outer peripheral surface of the piercing punch in a radial direction of the piercing punch, the support being supported so as to remain stationary with respect to the piercing punch in an axial direction of the piercing punch when the piercing punch enters the piercing die.

8. A die apparatus as claimed in claim 7 wherein the longitudinal axis of the piercing punch is perpendicular to the support surface.

9. A die apparatus as claimed in claim 7 wherein the support surface is planar.

10. A die apparatus as claimed in claim 9 wherein the support surface is parallel to the external surface of the piercing die which the support surface faces.

11. A die apparatus as claimed in claim 7 wherein the piercing punch extends to the support surface in the axial direction of the piercing punch.

12. A die apparatus as claimed in claim 7 including a press having a first portion and a second portion which can undergo relative movement with respect to each other in the axial direction of the piercing punch, the piercing die being supported by the first portion of the press, and the piercing punch and the support being supported by the second portion of the press such that the support remains stationary with respect to the piercing punch in the axial direction of the piercing punch when the first and second portions of the press undergo relative movement with respect to each other in the axial direction of the piercing punch.

13. A method of forming a press-formed metal component comprising:

placing a metal preform having a tubular boss portion and a flange over a lengthwise end of a punch with the punch extending into the boss portion, the boss portion having a first lengthwise end having an end portion and a second lengthwise end, the end portion of the boss portion extending transversely with respect to a longitudinal axis of the boss portion and defining a bottom of the boss portion, the flange being integrally formed with the boss portion and extending outwards from the boss portion at the second lengthwise end of the boss portion;

inserting the punch and the preform disposed on the punch into a first bore of a die, the first bore having a first end which opens onto an exterior of the die and a second end which is disposed inside the die;

with the boss portion disposed inside the first bore of the die, advancing the lengthwise end of the punch in a lengthwise direction of the punch into a second bore of the die past a cutting edge within the die to sever the end portion of the boss portion and leave a remainder of the boss portion in the first bore, the second bore being coaxial with the first bore and extending from the second end of the first bore; and then pressing a support which is disposed outside the die against the flange of the preform towards the die in the lengthwise direction of the punch to axially compress the preform between the support and an interior surface of the die located at the second end of the first bore so as to plastically deform the boss portion to increase its wall thickness and decrease its height measured in a lengthwise direction of the boss portion.

* * * * *